US005514016A

United States Patent [19]

Larson

[11] Patent Number: 5,514,016

[45] Date of Patent: May 7, 1996

[54] WATER SPORT SAFETY DEVICE AND METHOD

[76] Inventor: Joel R. Larson, 866 McDiarmid Cir., Hudson, Wis. 54016

[21] Appl. No.: 377,207

[22] Filed: Jan. 24, 1995

[51] Int. Cl.[6] ..... B63B 22/16

[52] U.S. Cl. ..... 441/6; 441/68

[58] Field of Search ..... 441/1, 6, 7, 11, 441/20, 21, 23, 28, 68, 70, 74, 65; 114/39.2; 116/173, 209

[56] References Cited

U.S. PATENT DOCUMENTS

| | | | |
|---|---|---|---|
| 2,716,758 | 9/1955 | Hajecate | 441/20 |
| 3,212,113 | 10/1965 | Barrett | 441/70 |
| 4,026,236 | 5/1977 | Robbins | 116/209 |
| 4,871,335 | 10/1989 | Grams | 441/68 |

*Primary Examiner*—Edwin L. Swinehart
*Attorney, Agent, or Firm*—Peter J. Gluck; Jonathan D. Spangler

[57] ABSTRACT

A water sport safety device for use with generally planar water sport devices which float at or beneath the surface of a body of water when floating unattended. The water sport safety device consists of a buoyant marker assembly which is attached to the water sport device so as to extend upward above the surface of the water when the water sport device is floating unattended in the water. The extension of the buoyant marker assembly above the surface of the water provides a highly noticeable and visible mark for water skiers, boaters and other water sportsman to identify the unattended water sport device, increasing the safety accorded the aforementioned individuals and increasing the ability to find and recover unattended floating water sport devices.

11 Claims, 2 Drawing Sheets

WATER SPORT SAFETY DEVICE AND METHOD

BACKGROUND OF THE INVENTION

The present invention relates to a safety device for water sports, and more particularly to a low cost apparatus and method for making water skis highly visible when lying idle in a body of water.

Through the years, water sports have become increasingly popular. In particular, the sport of water skiing enjoys widespread participation in more than 40 countries on at least four continents. In the United States alone, over 18 million persons a year participate in the sport of water skiing. Water skiing, of course, may be generalized as the activity in which a skier is supported on a single ski or pair of skis and is pulled across the surface of the water by a tow rope attached to a power boat.

While water skiing has gained widespread acceptance, it is generally recognized that a number of substantial dangers are involved in the exercise thereof. Aside from the physical dangers of falling or the like, boaters and skiers experience further danger of possible injury due to the virtually inevitable separation of the individual water skis from the particular water skier during the course of skiing.

Such separation of skier and water skis may be intentional, such as when a skier elects to drop from two skis to one ski in an effort to slalom ski, or unintentional, such as when a skier falls while skiing. In either event, the water skis come to rest at or slightly beneath the surface of the water such that they are difficult to observe by boaters, skiers, and other water sportsman, particularly if they are travelling at high rates of speed.

The danger of having water skis resting inconspicuously in the water is particularly real in congested or crowded lakes and the like. Often, such unattended floating water skis are virtually impossible to view until it is too late to avoid serious misfortune. In fact, boaters, skiers, and other water sportsman have been involved in substantial and numerous tragic accidents from colliding with, or swerving to avoid, water skis that float unattended in the water.

U.S. Pat. No. 3,212,113 disclosed an early attempt to address aspects of this longstanding issue. The disclosed combination included a spherical righting element mounted upon the dorsal surface of the water ski. However, those having a modicum of skill in the art soon realized that placing such a righting device upon the dorsal surface of the ski created yet another hazard, as the indicator itself often was caused to violently impact upon posterior portions of the skier's body. As such, improved saftey devices not inherently dangerous are required to overcome these problems.

Moreover, the device disclosed in U.S. Pat. No. 3,212,113 attempted to increase the visibility of the water ski by merely forcing the unattended water ski into a normal and upright position, with the boot extending into the air so as to alert passing water sportsmen. However, merely bringing the water ski into the upright position, with the boot extending upward into the air, does not effectively increase the visibility of the water ski. As noted above, unattended water skis, whether in an upright or overturned position, result in numerous accidents and injuries to boaters, skiers, and other water sportsmen.

A need therefor exists for increasing the safety of water skiing by increasing the visibility of water skis and similar water sport devices while floating unattended in the water. In particular, a water sport safety device is needed which adequately warns other boaters, skiers, and other water sportsmen regardless of whether the water ski is in the upright or overturned position.

SUMMARY OF THE INVENTION

Accordingly, it is a primary object of the present invention to provide an improvement in the safety accorded boaters, skiers, and other water sportsman by increasing the visibility of unattended floating water skis without further endangering skiers.

It is another object of the present invention is to provide a water safety device which is simple in design, rugged in construction, economical to manufacture, safe to use, and efficient in operation.

It is still another object of the present invention to provide a water safety device which is simple and convenient to attach to an existing or new water ski.

It is a still further object of the present invention to provide a water safety device which does not interfere with the smooth flow of the water ski during use.

It is a still further object of the present invention to provide a method of mounting the water safety device to a water ski without either substantially harming or defacing the water ski or violating its structural integrity.

It is still another object of the present invention to provide a water safety device having a smooth surface on which it is possible to silkscreen, print, or otherwise form desired images and designs.

According to one aspect of the invention, a water sport safety device includes marker means for increasing the visibility of the water sport device as the water sport device floats unattended in a body of water. Attachment means are employed for attaching the marker means to the water sport device. The marker means have a generally elongated and cylindrical shape, wherein the marker means maintains a substantially vertical and upright position while the water sport device floats unattended in the body of water.

According to another aspect of the present invention, a water sport safety device includes a marker assembly for marking a water sport device while floating unattended in a body of water, wherein the marker assembly has a generally planar shape that causes the water sport device to float at or below the surface of the body of water and wherein the marker assembly has a first end and a second end. An attachment assembly is employed for attaching the marker assembly to the water sport device, wherein a weight is enclosed within the first end of the marker assembly so that when the marker assembly is floating on water, the second end of the marker assembly extends upwardly therefrom.

In yet another embodiment of the present invention, a method is provided for increasing the visibility of water sport devices, wherein the method includes the steps of weighting one end of a buoyant float member and attaching the buoyant float member to the unattended floating water sport device.

The above, and other objects, features and advantages of the present invention will become apparent from the following description read in conjunction with the accompanying drawings, in which like reference numerals designate the same elements.

BRIEF DESCRIPTION OF THE DRAWING

A more complete understanding of the invention and its advantages will be apparent from the Detailed Description taken in conjunction with the accompanying drawings, in which.

DETAILED DESCRIPTION OF THE PREFERRED EMBODIMENT

Figure 1:
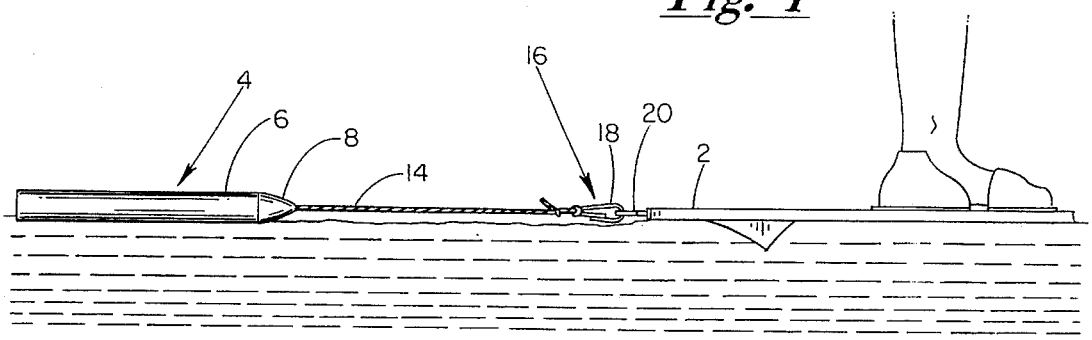
FIG. 1 is a side elevational view of the present invention used in a typical water skiing application.

Referring to FIG. 1, shown is a water ski 2 as it supports a water skier during use. A water sport safety device in accordance with the present invention includes a marker assembly 4 attached to the stern end of water ski 2 via connecting means 16. Marker assembly 4 includes a float body 6 coupled with a ballast cap 8 and a trail chord 14. Trail chord 14 includes a trail chord connector 18 at the end distal to ballast cap 8. Float body 6 can be adhesively or otherwise made secure in ballast cap 8 so that ballast cap 8 becomes a fixed part of float body 6.

Float body 6, in its preferred form, is fabricated of a high visibility material and selected colors which cooperate to increase the striking visibility of marker assembly 4. Float body 6 may optionally have a band of marine vinyl or similar material sewn or stitched thereto. This is desirable so that a pattern or message can be securely formed on float body 6 as by being silkscreened, painted or otherwise applied. The design applied to the surface of float body 6 depends on the message to be conveyed. A typical message may indicate caution, while other designs and symbols may be used for other purposes including to identify businesses, political divisions, and so forth. As such, float body 6 will have a smooth surface which decreases drag during use and will stand up without deteriorating even under severe environmental conditions such as under prolonged exposure to bright sunlight, severe weather conditions and prolonged exposure to water, including salt water.

As will be apparent to those skilled in the art, the presence of float body 6 maintained above water ski 2 substantially increases the visibility presented by marker assembly 4 and increases the likelihood that nearby boaters, skiers, and other water sportsman will have their attention drawn to the presence of water ski 2 in the water at sufficient distances to permit such individuals to avoid water ski 2.

The important aspect to observe in FIG. 1 is that the forward motion of water ski 2 across the surface of the water in accordance with normal water skiing activity produces opposite direction water resistance which tends to pull marker assembly 4 rearward from water ski 2. As such, marker assembly 4 trails smoothly and unobtrusively behind water ski 2 to avoid any interference therewith.

Float body 6 is preferably constructed of a foam or foam-like plastic material of sufficient thickness and strength to be able to extend in a substantially vertical condition from ballast cap 8 when marker assembly 4 is attached to an unattended floating water ski. The use of such materials is designed to insure adequate and longlasting buoyancy of float body 6 while marker assembly 4 is attached to an unattended floating water ski and to result in negligible drag of marker assembly 4 during normal water ski use. The use of such materials also produces a non-rigid member in marker assembly 4 to reduce the risk of injury to the water skier. Float body 6 may be made in various lengths; however, a typical length is between 20 and 30 inches.

Figure 2:
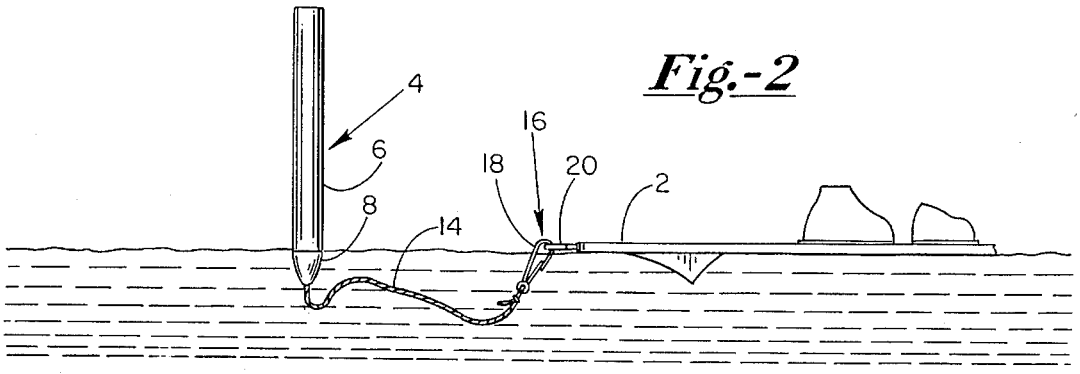
FIG. 2 is a side elevational view of an unattended water ski floating in a body of water with the present invention attached thereto.

Referring now to FIG. 2, shown is a water sport safety device in accordance with the present invention while attached to a water ski floating unattended in a body of water. It is an important aspect of the present invention that, while attached to an unattended water ski, marker assembly 4 maintains a generally vertical orientation with respect to its longitudinal axis. As such, the majority of float body 6 extends upward above the surface of the water.

Float body 6 is forced into this orientation due to a weight 10 (not shown) placed within ballast cap 8 which draws ballast cap 8 beneath the surface of the water so as to lift a majority of float body 6 out of the water. With float body 6 extending above the plane of the water, as shown in FIG. 2, the visibility of water ski 2 is greatly enhanced, thus increasing the protection afforded water skiers, boaters, and other water sportsman.

Figure 3:
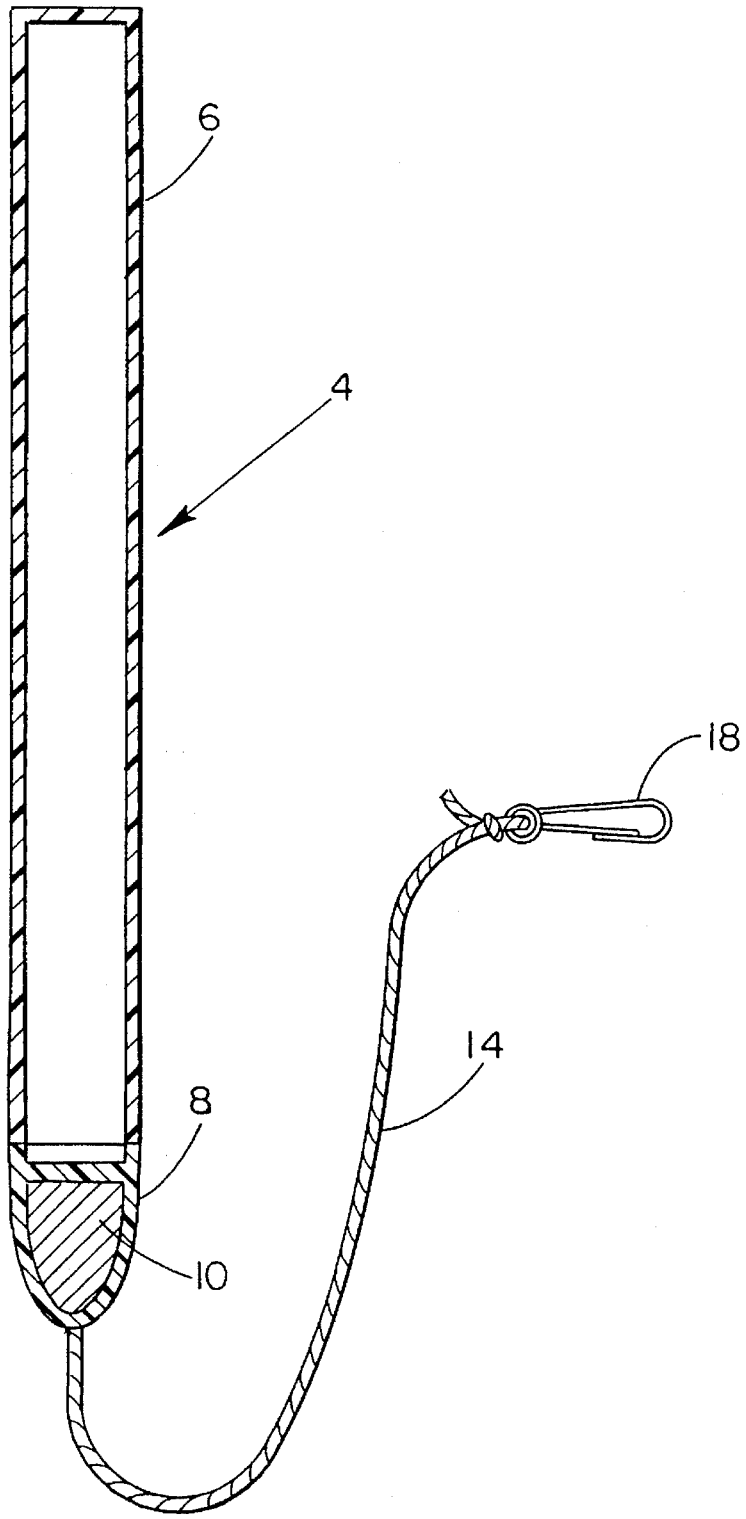
FIG. 3 is a partial cross-sectional view along the longitudinal axis of the present invention, detailing the construction thereof.

Referring now to FIG. 3, a weight 10 is located within ballast cap 8 by means of a ballast pocket 9. Ballast pocket 9 is built into ballast cap 8 at its manufacture. Weight 10 is made of a water impervious material with a specific gravity greater than 1.0. The size of weight 10 is selected to be large enough to maintain marker assembly 4 in a vertical or near vertical orientation with float body 6 clearly visible when marker assembly 4 is attached to an unattended water ski 2.

In one embodiment of the present invention, as shown in FIGS. 1 and 2, connecting means 16 comprises a clip-type trail chord connector 18 and an eyelet-type ski connector 20, both situated at the stern of water ski 2. However, the specific method of attaching trail chord 14 to water ski 2 is not critical. Any number of attachment mechanisms for securing trail chord 14 to the stern portion of water ski 2 may be utilized without departing from the scope of the present invention. Therefore, it will be apparent to those skilled in the art that marker assembly 4 may, if desired, be altered to accommodate virtually any number of attachment systems.

The water sport safety device in accordance with the present invention can be an after-market accessory as well as being provided as original equipment. The present invention is effective in increasing the visibility of water sport devices while they float unattended in the water. The water sport safety device in accordance with the present invention is also convenient, easy to use, reliable, durable and increases the protection accorded all individuals involved in water related activities. The water sport safety device of the present invention has great potential for reducing the number of potential injuries resulting from generally planar water sport devices that float unattended in the water.

It should be understood that marker assemblies of the present construction can be used for many different purposes and are not limited to use with water skis. For example, it is expected that the present invention could be used with knee-boards, surf-boards and the like which, like water skis, have a tendency to become separated from the user and which have a shape that is difficult to observe while floating unattended in a body of water.

Thus there has been shown and described novel marker assembly constructions which fulfill all of the objects and advantages sought therefor. It should be recognized, however, that the subject marker assembly 4 has many possible purposes and applications. It will be apparent to those skilled in the art that many changes, variations, modifications and other uses for the marker assemblies are possible and contemplated, and that all changes, variations, modifications and other uses and applications which do not depart from the spirit and scope of the invention are deemed to be covered by the invention which is limited only by the claims which follow.

What is claimed is:

1. A water sport safety device comprising:

marker means for marking the location of a water sport device as said water sport device floats unattended in a body of water, said marker means having a generally cylindrical and elongated shape defining a first end and a second end; and attachment means for attaching said marker means to said water sport device, wherein said marker means maintains a substantially upright position perpendicular to, and extending substantially above, the surface of said body of water while said water sport device floats unattended in said body of water, and wherein said marker means is towed behind said water sport device generally parallel to the surface of said body of water while said water sport device travels across the surface of said body of water.

2. A water sport safety device as set forth in claim 1 and further wherein:

said water sport device is substantially planar in shape; and said marker means is composed of a buoyant and watertight material.

3. A water sport safety device as set forth in claim 2 wherein said water sport safety device is colored with a luminescent color to increase its visibility.

4. A water sport safety device as set forth in claim 3 and further, wherein said first end of said marker means comprises a weighted ballast portion which causes said second end of said marker means to extend substantially above the surface of said body of water when said water sport device floats unattended in said body of water.

5. A water sport safety device as set forth in claim 4 and further, wherein said ballast portion of said first end includes a ballast pocket to accept and house a weight therewithin, and wherein said attachment means has a first fastening end, a second fastening end, and a tether portion defined therebetween.

6. A water sport safety device as set forth in claim 5 wherein said weight is composed of a water impervious material having a specific gravity greater than 1.0.

7. A water sport safety device comprising:

a buoyant marker assembly for marking a generally planar water sport device while said water sport device floats unattended in a body of water, said marker assembly having a first end, a second end, and a weight disposed within said first end; and an attachment assembly for attaching said marker assembly to said water sport device, wherein said weight of said first end draws said first end beneath the surface of said body of water when said water sport device floats unattended in said body of water, causing said second end of said safety device to extend vertically upward above the surface of said body of water from said first end.

8. A water sport safety device as set forth in claim 7 and further, wherein said attachment assembly includes a chord having a first end for connection to said first end of said marker assembly and a second end for connection to said water sport device, and wherein said marker assembly has a generally cylindrical and elongated body disposed between said first end and said second end, said weight having a specific gravity greater than 1.0.

9. A water sport safety device as set forth in claim 8 and further, wherein said elongated body of said marker assembly is luminescent in color to increase the visibility of said marker assembly when said water sport device floats unattended in said body of water, said first end of said marker assembly having a generally cylindrical shape that tapers gradually inward toward said first end of said chord of said attachment assembly so as to minimize the resistance of said marker assembly through said body of water as said marker assembly trails behind said water sport device during use.

10. A method of increasing the visibility of a water sport device for use in a body of water, said method comprising the steps of:

weighting one end of a cylindrical and elongated buoyant float member; and attaching said buoyant float member to said water sport device such that, during water sport device use, said buoyant float member drags behind said water sport device generally parallel to the surface of said body of water, and such that, during water sport device non-use, said buoyant float member floats generally perpendicular to, and extends substantially above, the surface of said body of water.

11. Method according to claim 10, said step of attaching further comprising:

utilizing said buoyant float member as means for marking to increasing the visibility of said water sport device as said water sport device floats unused in a body of water; by, affixing said buoyant float member to said water sport device by means for attaching said marker means to said water sport device;

skiing with said buoyant float member fixedly attached, wherein said means for marking has a generally elongated and cylindrical shape, wherein said marker means maintains a substantially vertical and upright position while said water sport device floats unused in said body of water; and, wherein said buoyant floating member extends substantially above the surface of the water when said water sport device floats unused in the water.

* * * * *